US006293803B1

(12) United States Patent
Rust et al.

(10) Patent No.: US 6,293,803 B1
(45) Date of Patent: Sep. 25, 2001

(54) ZEE ELECTRICAL INTERCONNECT

(75) Inventors: Thomas M. Rust, Agoura, CA (US); Edward M. Gaddy, Greenbelt, MD (US); Michael J. Herriage, Rancho Palos Verdes, CA (US); Robert E. Patterson, Manhattan Beach, CA (US); Richard D. Partin, Cypress, CA (US)

(73) Assignees: TRW Inc., Redondo Beach, CA (US); The United States of America as represented the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/501,412

(22) Filed: Feb. 9, 2000

(51) Int. Cl.[7] ..... H01R 41/00
(52) U.S. Cl. ..... 439/33; 174/69; 174/94 R
(58) Field of Search ..... 439/33; 174/69, 174/94 R, 129 R

(56) References Cited

U.S. PATENT DOCUMENTS 2,865,979 * 12/1958 Klassen ..... 174/69
3,488,430 * 1/1970 Holzhauser ..... 174/69
3,676,572 * 7/1972 Davies ..... 174/69
5,175,398 * 12/1992 Hofmann ..... 174/169

* cited by examiner

*Primary Examiner*—Brian Sircus
*Assistant Examiner*—Brian S. Webb
(74) *Attorney, Agent, or Firm*—Robert W. Keller

(57) ABSTRACT

An interconnect, having some length, that reliably connects two conductors separated by the length of the interconnect when the connection is made but in which one length if unstressed would change relative to the other in operation. The interconnect comprises a base element an intermediate element and a top element. Each element is rectangular and formed of a conducting material and has opposed ends. The elements are arranged in a generally Z-shape with the base element having one end adapted to be connected to one conductor. The top element has one end adapted to be connected to another conductor and the intermediate element has its ends disposed against the other end of the base and the top element. Brazes mechanically and electrically interconnect the intermediate element to the base and the top elements proximate the corresponding ends of the elements. When the respective ends of the base and the top elements are connected to the conductors, an electrical connection is formed therebetween, and when the conductors are relatively moved or the interconnect elements change length the elements accommodate the changes and the associated compression and tension forces in such a way that the interconnect does not mechanically fatigue.

9 Claims, 1 Drawing Sheet

ZEE ELECTRICAL INTERCONNECT

This invention described herein was made in the performance of work under Contract No. NAS-5-32500 awarded by the National Aeronautics and Space Administration and is subject to the provisions of Section 305 of the National Aeronautics and Space Act of 1958, as amended (42.U.S.C.2457).

BACKGROUND OF THE INVENTION

1. Field of the Invention

The present invention relates to electrical interconnects, and more particularly to an interconnect for electrically connecting two conductors separated by some length which repeatedly expands and contracts.

2. Description of the Prior Art

An important source of electrical power for an orbiting satellite is its solar array. In the solar array, an electrical connection is typically made between the solar cell circuits, which convert solar energy into electrical energy, and an electrical wiring harness, which conducts the electrical energy into the spacecraft. Such connections and the substrates to which they are mounted are subject to cyclical, extreme variations in temperature. These variations occur as the satellite orbits the earth. They result from the satellite being in complete sunlight at some times and being in the shadow of the earth at other times. These temperature variations, along with the coefficient of thermal expansion of the substrate, which carries the solar cell circuits and harness, cause a change in distance between those components. Similarly, the unstressed length of the electrical connection, which connects the circuits and the harness, changes, but by a different amount. As the substrate is generally stiffer than the electrical connection, the electrical connection is stressed.

In this regard it has been found that in certain solar arrays the electrical connection failed. Simply put, every hot to cold cycle slightly bent the electrical connection. Eventually, it failed due to mechanical fatigue.

A prior solution to the problem was the use of a conductor in the form of a ribbon electrical interconnect which had a half-loop formed intermediate to its ends to relieve stress. The stress relief improved performance compared to a flat conductor but was found inadequate for spacecraft that had many tens of thousands of repeated movements between the connected points.

What is needed, therefore, is an interconnect for electrically connecting the harness to the solar cell circuits that can accommodate the repeated changes in temperature. An additional requirement in some cases is that the interconnect must be low in height to accommodate the packing requirements for some solar arrays.

SUMMARY OF THE INVENTION

The preceding and other shortcomings of the prior art are addressed and overcome by the present invention which provides an interconnect for electrically connecting two conductors in which the distance between the conductors and the length of the unstressed interconnect change relative to each other. The interconnect includes a base element, an intermediate element and a top element. Each element is comprised of an electrically conducting material. The elements are arranged in a generally Z-shape with the free end of the base element connected to one conductor and the free end of the top element connected to the other conductor. The intermediate element has its ends disposed adjacent to corresponding ends of the base and the top elements. Brazes electrically and mechanically secure the intermediate element to the respective base and top elements which proximate the corresponding free ends of the elements. This configuration enables the three elements to accommodate changes in the separation distance between the conductors and to absorb the associated compression and tension forces on the elements. In addition, the increased length of the conductive elements compared to prior art elements, enables them to be less stressed by dramatic changes in the temperature of the environment.

Equivalently, the present invention relates to an interconnect for electrically connecting two conductors separated by some length which remains fixed while the unstressed length of the interconnect changes, generally due to its coefficient of thermal expansion as it is heated or cooled. It also relates to an interconnect for electrically connecting two conductors separated by some length which expands and contracts while the unstressed length of the interconnect also expands and contracts, but at a different rate. More succinctly, the invention, having some length, reliably connects two conductors separated by the same length when the connection is made; but in which the one unstressed length cyclically changes relative to the other in operation.

The foregoing and additional features and advantages of this invention will become apparent from the detailed description and accompanying drawing figures below. In the figures and the written description, numerals indicate the various elements of the invention, like numerals referring to like elements throughout both the drawing figures and the written description.

DETAILED DESCRIPTION OF THE PREFERRED EMBODIMENTS

Figure 1:
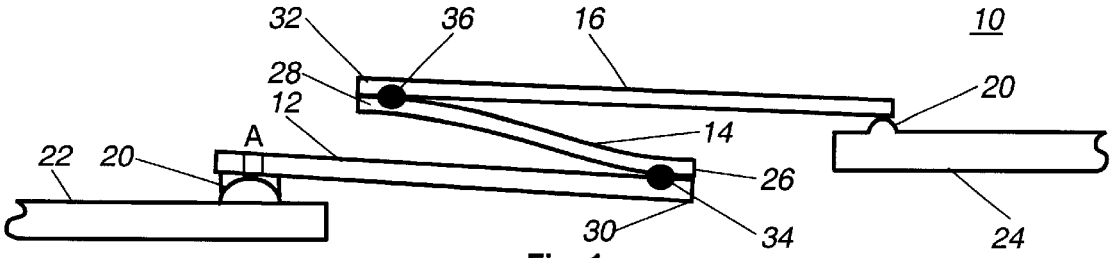
FIG. 1 diagrammatically illustrates the interconnect in accordance with the present invention.
Figure 2:
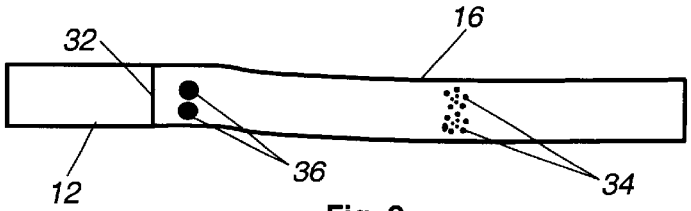
FIG. 2 is a top plan view of the interconnect illustrated in FIG. 1.

FIG. 1 and FIG. 2 illustrate the invention. The invention is generally designated by the numeral 10. Briefly, the interconnect 10 includes a base element 12, an intermediate element 14 and a top element 16. Each element 12, 14 and 16 has an elongated shape with a rectangular cross section such that it appears to resemble a ribbon, and is formed from an electrically conducting material, such as copper, Kovar™ or other conductor. The elements are arranged in a compact Z-shape with a relatively small height as measured from the bottom surface of he base element 12 to the uppermost area of the top surface 16.

More particularly, the intermediate element is arranged with its ends 26 and 28 disposed against the end 30 of the base element and the end 32 of the top element 16. Two brazes 34 secure the intermediate element 14 to the base element 12 and two brazes 36 to secure it to the top element 16 at locations proximate the ends of the elements. The base element 12 and the top element 16 are secured to the contacts 20 on the respective conductors 22 and 24 by solder, although small rivets, brazing, or the like can also be used. Thus electrical continuity between the conductors is achieved.

In an alternative embodiment the brazed joints are replaced with solder joints or with any similar means of making the physical and electrical connection between the base, intermediate and top elements.

In operation, the interconnect 10 provides a continuous electrical path from the contact 20 on conductor 22 through the elements 12, 14 and 16 to the contact 20 on conductor 24.

In a preferred embodiment the conductors 22 and 24, respectively, serve to mount solar cell circuits on a solar cell panel or blanket and an electrical wiring harness. The solar cell circuits are generally used on orbiting satellites to receive solar energy and convert it into electrical energy to power the electrical equipment in the satellite. The solar cell blanket or panels extend from the satellite and are therefore subject to extreme temperature changes. Because of temperature changes, the surfaces containing the solar cell circuits and the wiring harness constantly change position (both vertically and horizontally as shown in FIG. 1) and exhibit many contractions or expansions in distance therebetween. This induces both compression and expansion in the interconnect and could induce stresses to the contacts for solar cell circuits and the wiring harness. As described the interconnect 10 spreads the strain due to length change over an area of the body of the base, the intermediate and the top elements. This enables the interconnect to undergo repeated compression and expansion cycles without cracking. As the conductive material of the interconnect has a characteristic stiffness that is less than that of the platform on which the conductors are fixed, it is the conductive material that bends and not the platform.

Figure 3:
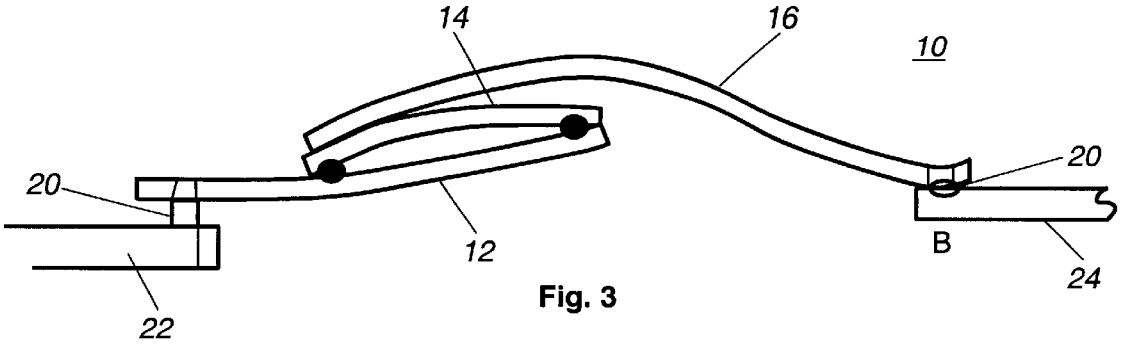
FIG. 3 is a diagrammatic representation of the interconnect shown in FIG. 1 when it is subjected to compression.
Figure 4:
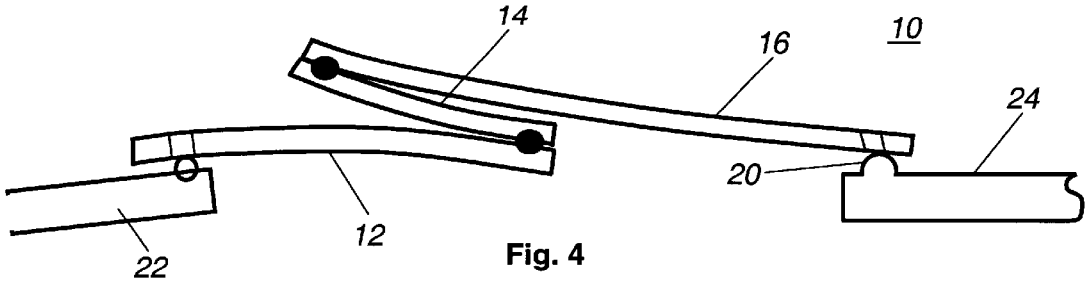
FIG. 4 is a diagrammatic representation of the interconnect shown in FIG. 1 when it is subjected tension.

Referring now to FIGS. 3 and 4 the functional operation of the interconnect is shown when subjected to compression and expansion. In FIG. 3 effects of compression are illustrated. In compression the distance between the contacts 20 of the separated conductors 22 and 24 is smaller or the length of the interconnect has increased from that illustrated in FIG. 1 and the interconnect has a shape in which the base element 12 bends upwardly, the intermediate element 14 curves so that its end 28 is adjacent the base element 12 and the top element 16 curves as shown. In FIG. 4, the interconnect is shown under expansion whereby the distance between the contacts 20 is greater and/or the length of the interconnect has decreased from that illustrated in FIG. 1. As illustrated, the base element 12 is curved "down" slightly, the intermediate element 14 separates from the base element 12 with a curved shape and the top element 16 has a generally curved shape. Although the distance between the contacts changed and/or the length of the interconnect changed, the interconnect absorbed the change by bending in a manner that reduces fatigue to negligible levels. In comparison, the prior art interconnect having a half-loop formed in the conducting material so as to relieve strain concentrates the bending at the top of its half loop. Therefore, the prior art interconnect undergoes stress that is much higher at the top of the loop and under repeated cycling has been found to fail.

Displacement tests on interconnects 10 formed in accordance with the present invention produced the following results. In the tests, the greater the displacement, the more likely it is that an interconnect will fail at a lower number of displacement cycles. In five of the six tests conducted, the interconnect of the present invention did not fail before the test was stopped. More particularly, six interconnects that were annealed, 0.2 inches wide, 0.6 inches high and 4.0 inches in length with brazes to secure the elements and six interconnects having the same characteristics except that the height was 0.5 inches high were subject to displacement tests. In this, the interconnects were displaced ±0.015 inches over 1,000,000 cycles without failing. In contrast, two tests on prior art interconnects with the half-loop stress relief portion were tested to a lesser displacement of ±0.006 inches. One failed at 23,689 cycles and the other failed at 71,431 cycles.

Figure 5:
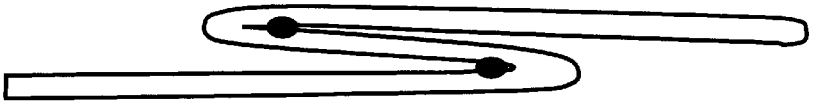
FIG. 5 is an alternative embodiment of the interconnect.

Referring now to FIG. 5 an alternative embodiment of the interconnect 10 is illustrated in accordance with the present invention. As shown the interconnect 10 has base 12, intermediate 14, and top 16 elements that are formed from an integral piece of conductive material such as copper or Kovar™. There are two spot brazes 34 connecting a portion of the base to the intermediate element and two spot brazes 36 connecting the intermediate element 14 to the top element 16. The embodiment illustrated conducts electrical current between separated conductors and operates in exactly the same manner as that previously described.

Accordingly, an improved interconnect for mechanically and electrically connecting contacts on separated moveable surfaces that is of low height and withstands changes in temperature and displacement is provided.

Obviously, many modification and variations of the present invention are possible in view of the above teachings. Thus, it is to be understood that, within the scope of the appended claims, the invention may be practiced otherwise as specifically described above.

What is claimed is:

1. An interconnect for electrically connecting two conductors associated with solar cell circuits used on satellites comprising:

a base element, an intermediate element, and a top element, each element being elongated with a longitudinal dimension and formed of a conducting material and having opposed ends, said elements having a thin rectangular cross section and being without insulation and arranged in a generally Z-shape with said base element having one end adapted to be connected to one conductor associated with a solar cell circuit, said top element having one end adapted to be connected to another conductor associated with another solar cell circuit, and said intermediate element having its ends disposed against the other ends of said base and said top elements; and means mechanically and electrically interconnecting said intermediate element to said base and said top element proximate the corresponding ends of said elements, whereby when said respective ends of said base and said top elements are connected to the conductors, an electrical connection is formed therebetween, having a length that changes corresponding to temperature changes of the environment, and when said conductors are relatively moved or the elements themselves expand or contract due to the temperature changes the elements absorb the corresponding separation distance and the associated compression and tension forces.

2. The interconnect as set forth in claim 1, wherein said base, said intermediate and said top element have a uniform width.

3. The interconnect as set forth in claim 1, wherein said base, said intermediate and said top element are formed from a metal.

4. The interconnect as set forth in claim 1, wherein said base, said intermediate and said top element are an integral structure.

5. The interconnect as set forth in claim 1, wherein said elements are formed from a conductive material that has a characteristic stiffness that is less than that of the platform on which the conductors are fixed.

6. The interconnect as set forth in claim 1, wherein said means of mechanically and electrically interconnecting the interconnects' elements comprises a braze.

7. The interconnect as set forth in claim 1, wherein said means of mechanically and electrically interconnecting the interconnects' elements comprises solder.

8. The interconnect as set forth in claim 1, wherein said elements spread strain associated with distance change between the conductors throughout their length.

9. In a solar array having separated surfaces on which a wiring harness and a plurality of solar cell circuits are respectively mounted, an improved interconnect for electrically connecting the wiring harness to the solar cell circuit comprising:

a base element, an intermediate element and a top element, each element having a thin rectangular cross section, being elongated and formed from a conducting material without insulation, and having opposed ends, said elements arranged in a generally Z-shape with said base element having one end adapted to be connected to a contact on the solar cell circuit, said top element having one end adapted to be connected to the contact on the wiring harness, and said intermediate element having its ends disposed against the other ends of said base and said top elements; and means mechanically and electrically interconnecting said intermediate element to said base element and to said top element proximate the corresponding ends of said elements, whereby when said respective ends of said base element and said top element are connected to the contacts, an electrical connection is formed therebetween, said electrical connection having a relatively low height and a length that changes due to environmental temperature changes such that, the elements accommodate the associated compression and tension forces due to the temperature change.

* * * * *